US005122204A

United States Patent [19]

McDonald

[11] Patent Number: 5,122,204

[45] Date of Patent: Jun. 16, 1992

[54] CAMSHAFTS

[75] Inventor: Alexander K. McDonald, Woolaston, England

[73] Assignee: Lydmet Limited, Lydney, England

[21] Appl. No.: 679,185

[22] Filed: Apr. 2, 1991

[51] Int. Cl.[5] ..... B22D 15/00

[52] U.S. Cl. ..... 148/323; 164/127; 164/352; 148/904

[58] Field of Search ..... 164/127, 47, 352; 148/323, 904

[56] References Cited

FOREIGN PATENT DOCUMENTS 58-112651 7/1983 Japan ..... 164/127

63-264247 11/1988 Japan ..... 164/127

*Primary Examiner*—Kuang Y. Lin

*Attorney, Agent, or Firm*—William R. Hinds

[57] ABSTRACT

A method of producing a chilled iron camshaft is described, wherein the iron has a white iron structure adjacent chill inserts in a casting mould and a grey iron structure in substantially all other regions remote from the chills. The method comprises the steps of assembling a sand casting mould having a camshaft shaped cavity and also having chill inserts adjacent the cavity regions where while iron is desired, preparing a molten metal charge of cast iron having a carbon equivalent lying in the range from 3.3 to 3.85 wt % and adding sufficient nucleant prior to pouring to fill the mould cavity to ensure that undercooling of residual liquid remaining after solidification of the white iron structure adjacent the chills remains above the iron-cementite eutectic temperature prior to solidfication into grey iron.

4 Claims, 3 Drawing Sheets

CAMSHAFTS

The present invention relates to a method for the manufacture of camshafts.

Camshafts for use in, for example, internal combustion engines have been made in cast iron. There are two production methods which have been used most extensively, these are; to cast the camshaft in a hardenable iron followed by, for example, induction hardening of the cam lobes or to incorporate cold metal chills in the casting mould to produce a white iron chill cast structure in the cam lobes during the casting process. It is the latter production process with which the present invention is principally concerned.

Camshafts generally comprise an elongate shaft on which the valve operating cams are disposed in varying orientations together with camshaft bearing journals and also sometimes other features, such as ancilliary equipment drive gears or various projections, for example, which require post-casting machining. Indeed, the shaft itself often requires a bore to be produced along the shaft centre, the bore usually being produced by the technique known as "gun-drilling". The white iron structure of cast iron is ideally confined to the cam lobe regions where it is desirable for its' wear resistant properties which stem from the high hardness of this type of structure. White iron comprises iron carbides in a pearlite matrix; the iron carbides rendering the metal so hard that the cam lobes are normally finished by grinding. Where metal cutting operations need to be performed on portions of the cast camshaft it is desirable that such portions solidify as grey iron which has a structure comprising graphite flakes in a pearlite matrix and which is readily machinable by normal metal cutting techniques.

Which form of cast iron is produced on solidification will depend, principally, upon several factors which include the chemical composition of the iron being cast, the cooling rate of the metal during solidification and the degree of nucleation applied to the molten metal.

With conventional chill cast camshafts, white iron is produced at the cam lobe surface by the use of metal chills placed in the casting mould, which is generally composed of sand. The metal chills produce a sufficiently high cooling rate such as to ensure solidification of the molten cast iron as white iron adjacent the chills. A problem arises in some designs of camshafts where a particular feature, which requires subsequent machining, has a relatively low metal volume compared to the area of the adjacent sand mould material. In this instance the cooling rate produced by the said mould itself may be sufficiently high to produce white iron in such features thus causing machinability problems.

The formation of grey iron on solidification is a nucleation and growth reaction, the carbon atoms precipitate onto a suitable nucleating site, which may be an oxide or sulphide inpurity particle or may be a deliberately added material such as ferrosilicon or calcium silicide, for example, and grow as graphite flakes, usually in the form of "rosettes". The diffusion of carbon atoms through the solidifying metal to form graphite flakes takes time and, if there are relatively few nucleation sites, they have to travel further which increases the necessary time required for diffusion.

The effect of the requirement of time for diffusion is that, where there is a superimposed high cooling rate due to a chill insert or localised area of sand mould, insufficient diffusion time is available before the metal adjacent the chill becomes undercooled below the iron-cementite (iron carbide) formation eutectic temperature on the iron-carbon phase diagram and the iron solidifies in the metastable white iron form.

In the regions of the solidifying camshaft remote from the chills, the rate of cooling is far lower than that adjacent the chills, therefore, more time is available for the diffusion of carbon in the still molten iron and, by adjustment of the level of nucleation of the molten charge prior to pouring, these regions may be induced to solidify in the grey iron form.

However, control of the level of nucleation is critical and too high a level may result in not meeting a specification for the minimum depth of white iron to be achieved and too low a level may result in a high proportion of white iron appearing in the grey iron regions, this again leading to machinability problems. A further disadvantage of this is that inconsistent mechanical properties will result in the grey iron parts of the camshaft; the grey iron parts may, for example, be too brittle.

A yet further disadvantage is that where a high level of nucleation is employed in order to overcome the machinability difficulties, due to kinetic factors associated with the eutectic solidification reactions promoted by the non-equilibrium thermal effect arising in the mould in practice, some grey iron cells may arise within the white iron structure causing a lowering of the hardness and, therefore, impairing the wear resistance of the material, which is undesirable. Adjustment of the nucleation to a lower level to prevent undesirable grey iron cells within the white iron regions results in an increase in white iron depth as well as promoting the formation of some white iron carbides within the desired grey iron region as described above. The net effect of this may be to make the production of a bore by gun-drilling infeasible, especially in camshaft designs requiring a 360 degree, full peripheral white iron zone.

Some other elements, of which the most important is silicon, have a similar effect to carbon on the solidification of cast iron; 1 weight % of silicon has the same effect as 0.25 weight % of carbon. It is usual, therefore, to quote cast irons as having a "carbon equivalent" (CE) which is arrived at by adding together the total percentage of carbon and $0.25\times$the total percentage of silicon. There are other elements, such as phosphorus for example, which have a carbon equivalent effect but are less important.

In the production of chilled iron camshafts heretofore, it has been common to employ a CE in the range from 3.9 to 4.3, this CE comprising about from 3.5 to about 3.9 weight percent of carbon, the remainder silicon. This level of CE is close to the cast iron eutectic composition of 4.3 and has been used for a further important reason. It has been customary, for economic reasons, to use a "self-feeding" iron owing to there being only one combined feeder and riser in the camshaft casting mould. All solidication shrinkage is fed from the liquid shaft core and, because of the need to feed from one end to the other of the whole shaft the shrinkage negating effect of the higher carbon level has been virtually mandatory.

A method has now been found of producing chilled iron camshafts where the demarcation between the white and grey iron regions is more clearly defined, white iron is produced substantially only in the desired regions adjacent the metal chills and the grey iron regions are more homogeneous and, therefore, have more uniform and better mechanical properties.

According to a first aspect of the present invention, there is provided a method of producing a chilled iron camshaft, the iron having a white iron structure adjacent chill inserts in a casting mould and a grey iron structure in substantially all other regions remote from the chills, the method comprising the steps of assembling a sand casting mould having a camshaft shaped cavity and also having chill inserts adjacent the cavity regions where white iron is desired, preparing a molten metal charge of cast iron having a carbon equivalent lying in the range from 3.3 to 3.85 wt% and adding sufficient nucleant prior to pouring to fill the mould cavity to ensure that under cooling of residual liquid remaining after solidification of the white iron structure adjacent the chills remains above the iron-cementite eutectic temperature prior to solidification into grey iron.

A CE of 3.3 to 3.85 may typically include from 2.9 to 3.4 wt% of carbon, the remainder being substantially silicon.

In the method according to the invention, the cooling rate is dictated (as it was in the prior art method) by the chills in the mould and by the mould material itself. Given the controlled cooling rate the depth of the white iron layer is now governed by the chemistry of the molten cast iron alone; principally by the C.E and, the nucleation is now fixed at an upper level which ensures that substantially all the non-white iron liquid solidifies as grey iron. Nucleation now becomes, effectively, a fixed, easily controlled, non-variable parameter.

According to a second aspect of the present invention there is provided a camshaft when made by the method of the first aspect of the present invention.

In order that the present invention may be more fully understood, an example will now be described by way of illustration only with reference to the accompanying drawings, of which:

Figure 1:
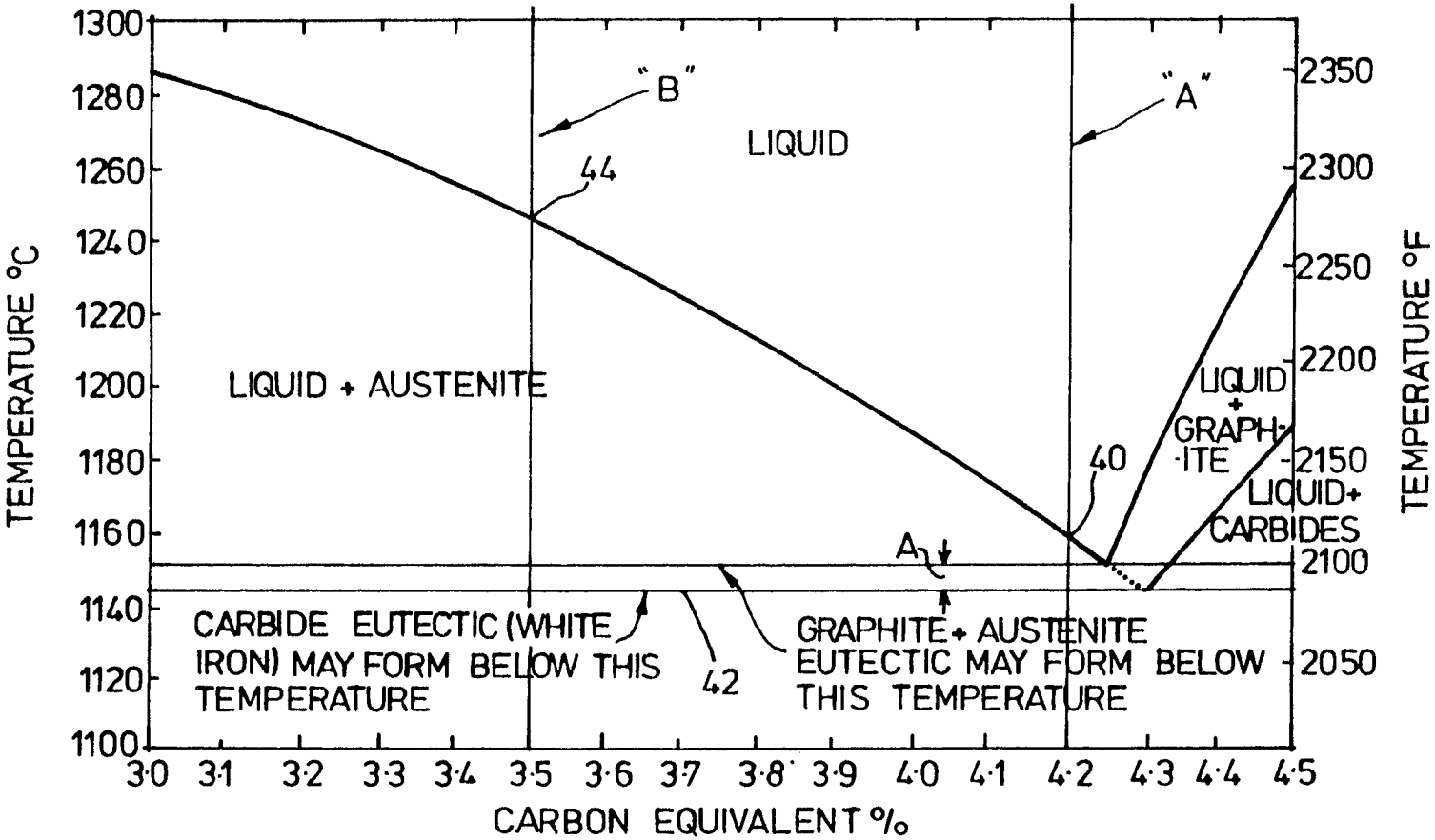
FIG. 1 shows a part of an Iron-Carbon Equivalent phase diagram in the region of the eutectic point.

It should be noted that in the phase diagram of FIG. 1 the two values of eutectic temperatures illustrated are theoretical and the actual eutectic temperatures vary in practice depending upon the actual iron chemical composition with regard to carbon equivalent elements.

Figure 2:
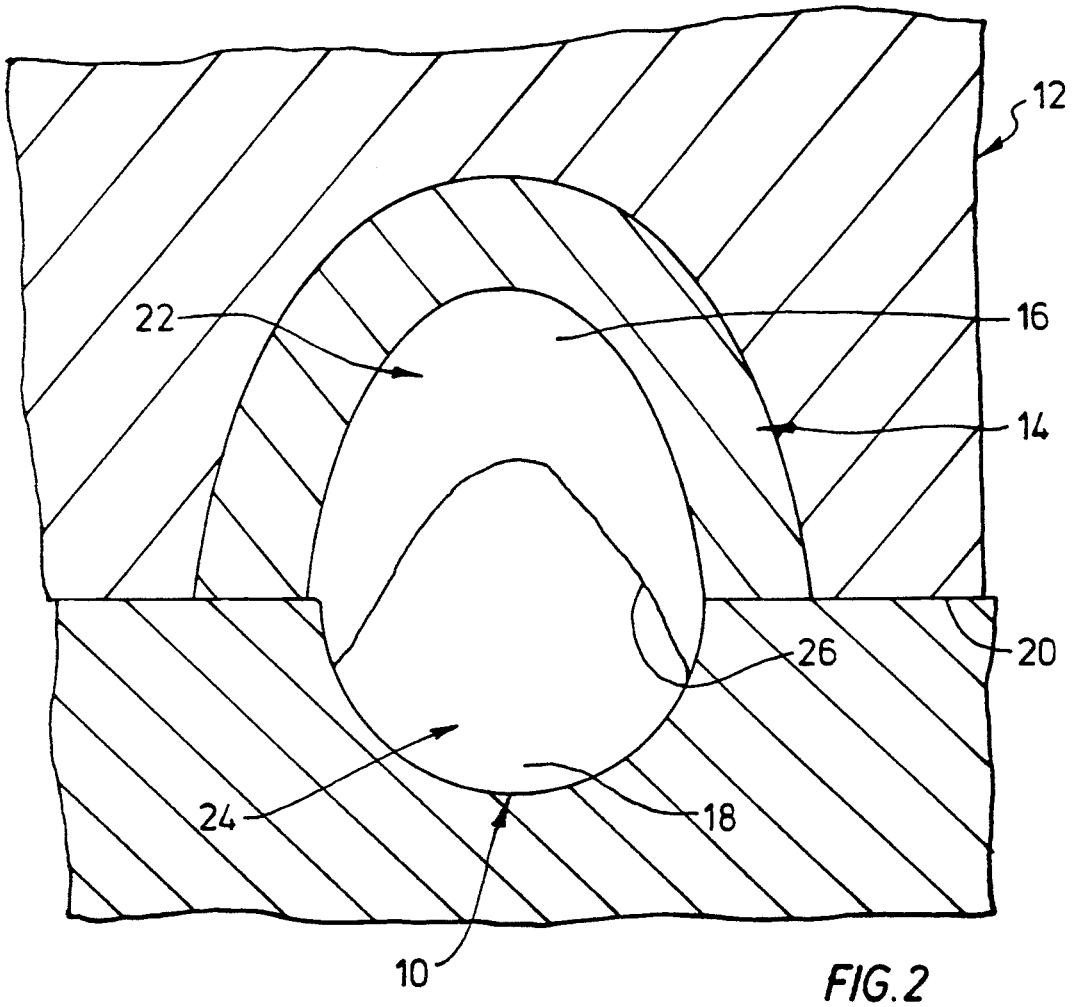
FIG. 2 shows a radial cross section through a mould cavity of a cam in a camshaft and an adjacent metal chill.

Referring now to FIGS. 1 and 2 and where the solidification of a prior art alloy 'A' having a C.E of 4.2% will first be described followed by a description of the cooling of an alloy 'B', having a C.E of 3.5%, by the method of the present invention. Both the following descriptions will relate to solidification of a cam 10 in a cavity of a sand mould 12 wherein there is a relatively cold metal chill 14 adjacent the cam portion 16 and not adjacent the heel portion 18. The mould 12 also having a parting line 20.

The molten metal 22 adjacent the chill 14 will experience a comparatively very high cooling rate compared with the metal 24 remote from the chill. The boundary between these two regions is indicated by the line 26. It will be appreciated by those skilled in the art, however, that the line 26 is only generally indicative of the region 22 which solidifies as white iron and the region 24 which solidifies as grey iron. It will be apparent to those skilled in the art that the metal immediately adjacent each side of the boundary 26 will experience substantially the same cooling conditions and that any boundary between the two constituents can be indicated only in general terms.

Figure 3:
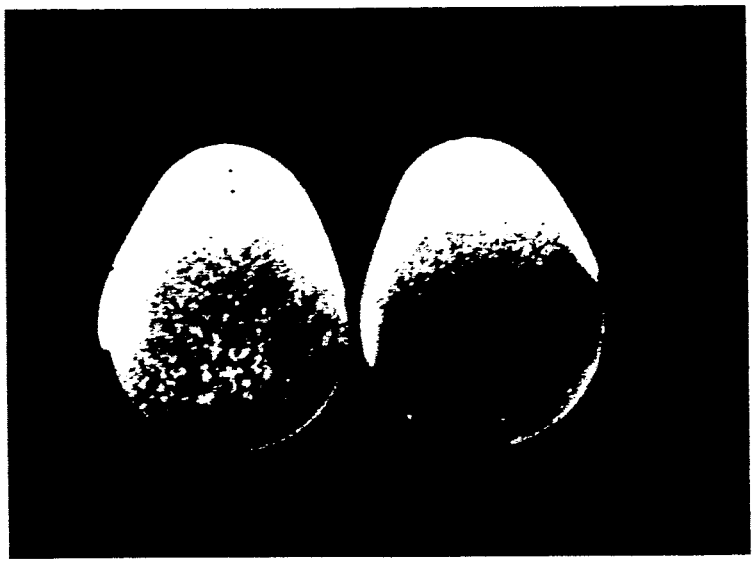
FIG. 3 which shows a photomicrograph of sections through two cams; the one on the left having been cast by a conventional method and the one on the right by the method according to the present invention.

Molten iron is poured into the mould cavity at a pouring temperature which is substantially above the temperature of about 1160° C., indicated at 40 in FIG. 1 and, at which temperature the metal will begain to precipitate solid material in the form of austenite. As the metal temperature falls rapidly in the region 22 adjacent the chill, insufficient time is available for carbon diffusion, substantial undercooling of the molten metal results which brings the temperature below the iron-iron carbide eutectic temperature, indicated by line 42, causing the metal in region 22 to solidify as white iron. The molten metal in region 24, remote from the chill 14 is subjected to a slower cooling rate and the metal ideally possesses a level of nucleation which provides many sites for the growth of the typical graphite "rosettes" seen in grey iron, thus allowing little or no undercooling of the metal and causing the metal in the region 24 to solidify as grey iron. However, to ensure that the minimum specified depth of white iron is achieved in region 22 it is customary to err on the side of a lower level of nucleation than would cause all the metal in region 24 to solidify as grey iron. Because the level of nucleation is, in any case, difficult to control accurately, the effect of this is often to cause the metal in region 24 to solidify as a mixture of grey and white iron. The result is to produce a "core" of metal in the camshaft centre which is difficult, or impossible, to machine. Reference to the cam shown on the left of FIG. 3 shows the structure which is often produced by the conventional method; the light areas are white iron and the dark areas are grey iron. It may be seen that the lower grey iron region 22 has a "mottled" appearance indicating the presence of white iron.

Referring now to the solidification of alloy 'B' shown in FIG. 1 and which alloy has a carbon equivalent of 3.5%. Solidification begins to occur at point 44, approximately 1250° C., at which temperature the austenite or gamma phase begins to precipitate from the liquid (it will be appreciated that the externally applied cooling conditions via the chill 14 are substantially the same as for alloy 'A'). As cooling proceeds rapidly in the region 22 adjacent the chill 14, the proportion of the solid austenite phase to liquid increases until the eutectic temperature is reached. The cooling rate in region 22 is the structure determining factor and the austenite phase transforms to the white iron structure, the remaining liquid in region 22 undercools to below the iron-iron carbide eutectic temperature, indicated by line 42, since insufficient time is available for carbon diffusion this liquid also solidifies as white iron. The slower cooling metal in region 24, due to the fact that the poured metal charge possessed a level of nucleation which ensures solidification as grey iron, solidifies as grey iron without the presence of included white iron. It is a comparatively simple and easily controlled matter to ensure that the nucleation level is high enough to ensure solidification as grey iron in region 24. The high level of nucleation does not, however, prevent white iron forming in region 22 as this is governed by the cooling rate and the presence of sufficient austenite phase precipitating from the liquid during solidification which is initiated at a higher temperature.

A very important additional advantage of the method of the present invention is that by ensuring that all the available carbon in region 24 is converted to the graphite form as grey iron, rather than the mixed grey and white form of the prior art method, then the cast iron composition in effect becomes sufficiently self-feeding not to need any other external feeders on the casting.

I claim:

1. A method of producing a chilled iron camshaft, the iron having a white iron structure adjacent chill inserts in a casting mould and a grey iron structure in substantially all other regions remote from the chills, the method comprising the steps of assembling a sand casting mould having a camshaft shaped cavity and also having chill inserts adjacent the cavity regions where white iron is desired, preparing a molten metal charge of cast iron having a carbon equivalent lying in the range from 3.3 to 3.85 wt% and adding nucleant prior to pouring, and pouring the molten metal to fill the mould cavity to form the camshaft, wherein said range of carbon equivalent and said nucleant addition are sufficient to ensure that undercooling of residual liquid remaining after solidification of the white iron structure adjacent the chills remains above the iron-cementite eutectic temperature prior to solidification into grey iron.

2. A method according to claim 1 wherein the carbon equivalent includes from 2.9 to 3.4 wt% of carbon.

3. A method according to claim 2 wherein the carbon equivalent remainder is substantially silicon.

4. A camshaft when made by the method claim 1.

* * * * *

UNITED STATES PATENT AND TRADEMARK OFFICE

CERTIFICATE OF CORRECTION

PATENT NO. : 5,122,204

DATED : June 16, 1992

INVENTOR(S) : Alexander K. McDonald

It is certified that error appears in the above—identified patent and that said Letters Patent is hereby corrected as shown below:

On the title page of the printed patent, the information page, between the lines "[22]" and "[51]," the following is added: --

[30] Foreign Application Priority Data

Apr. 21, 1990 [GB] United Kingdom ..... 9009004.4--

Signed and Sealed this

Tenth Day of August, 1993

*Attest:*

Michael K. Kirk

MICHAEL K. KIRK

*Attesting Officer*

*Acting Commissioner of Patents and Trademarks*